US007645939B2

(12) United States Patent
Gallens et al.

(10) Patent No.: US 7,645,939 B2
(45) Date of Patent: Jan. 12, 2010

(54) RETROREFLECTING ELONGATED METAL WIRE PRODUCT

(75) Inventors: Jeroen Gallens, Kortrijk (BE); Alain Leplae, Moorsele (BE); Filip Acx, Oostkamp (BE)

(73) Assignee: NV Bekaert SA, Zwevegem (BE)

( * ) Notice: Subject to any disclaimer, the term of this patent is extended or adjusted under 35 U.S.C. 154(b) by 0 days.

(21) Appl. No.: 12/092,372

(22) PCT Filed: Nov. 2, 2006

(86) PCT No.: PCT/EP2006/068020

§ 371 (c)(1),
(2), (4) Date: May 1, 2008

(87) PCT Pub. No.: WO2007/054457

PCT Pub. Date: May 18, 2007

(65) Prior Publication Data

US 2008/0277138 A1 Nov. 13, 2008

(30) Foreign Application Priority Data

Nov. 9, 2005 (EP) ..... 05110543

(51) Int. Cl.
*H01B 7/00* (2006.01)

(52) U.S. Cl. ..... 174/110 R; 174/112

(58) Field of Classification Search ..... 174/110 R, 174/112, 115, 36, DIG. 8
See application file for complete search history.

(56) References Cited

U.S. PATENT DOCUMENTS

| | | | | |
|---|---|---|---|---|
| 4,697,407 | A | 10/1987 | Wasserman | |
| 5,390,619 | A * | 2/1995 | Miller | 114/243 |
| 6,355,349 | B2 * | 3/2002 | Chizmas | 428/383 |
| 6,388,194 | B1 * | 5/2002 | Ryeczek | 174/112 |
| 6,437,248 | B1 * | 8/2002 | Giebel | 174/110 R |
| 6,498,300 | B2 * | 12/2002 | Flick | 174/110 R |
| 6,727,433 | B2 * | 4/2004 | Tsai | 174/110 R |
| 7,442,877 | B2 * | 10/2008 | Kamata et al. | 174/110 R |
| 2004/0180199 | A1 | 9/2004 | Kang | |

FOREIGN PATENT DOCUMENTS

EP 1 076 342 B1 2/2001

* cited by examiner

*Primary Examiner*—William H Mayo, III
(74) *Attorney, Agent, or Firm*—Foley & Lardner LLP

(57) ABSTRACT

A metal wire is first coated with a coating. In this first coating, retro-reflective beads are partly embedded. Thereafter the beads and the first coating are covered by a protective coating. The metal wire is made from a strand or wire made of stainless steel, or low carbon steel, or high carbon steel. The retro-reflective metal wire is used for diverse applications, such as spoke wire, signalization means, or bookbinding wire.

14 Claims, 2 Drawing Sheets

RETROREFLECTING ELONGATED METAL WIRE PRODUCT

FIELD OF THE INVENTION

The invention relates to elongated metal wire products that are covered with a coating having retro-reflective properties. Such metal wire products are to be used in situations where the visibility of structures can be augmented by the retro-reflection of the light incident on that product. The metal wire products can therefore be used for marking the sides of highways or as a spoke wire in a bicycle wheel or as an advertising means when formed in the shape of characters or in any kind of a similar application.

BACKGROUND OF THE INVENTION

The ever-increasing traffic density has spurred pedestrians and cyclists to make themselves more visible in twilight or nightly illumination conditions in order to survive. To this end they carry retroreflective strips either as arm or leg bands or integrated into their garments or on their bikes. Such lifesaving gadgets are generally made in the form of strips. Characteristic for such retro-reflective strips is that upon illumination by a beam of light, they return the light in a cone having an axis in the direction of the impinging beam. The term retroreflective is used here to discriminate the reflection mechanism from diffusive reflection—in which the impinging light is scattered in all directions evenly—or specular reflection—when the incident light is reflected away under an equal but opposite angle to the normal on the surface.

There are a number of means available to entail this retroreflectivity into an article. Cube corner reflectors are generally used in reflectors that are rigid as for example in the fixed reflectors of a car. As such they cannot be used on flexible substrates such as strips or rope like material. In order to overcome this latter difficulty, very small (smaller then 1 mm) glass pyramids have become available. When such glass pyramids are embedded into a coating on a substrate some of the pyramids will be properly aligned with the incident beam and effectively shine back the light. Such a structure can be recognised in the dark because it tends to twinkle when one is moving by, the twinkling being due to different micro pyramids that become properly aligned with the impinging beam. The micro pyramids are less preferred for products with a limited area available for retroreflection (such as e.g. spokes of a bicycle wheel). By far the most preferred retroreflective means are very small 'glass beads' made out of a highly refracting, transparent material. Indeed, geometrical optics readily shows that a caustic focal region of a transparent sphere forms close to the surface opposite from the impinging light on the optical axis. When now a reflective layer is provided on the back surface, most of the converging light will return in a cone around the incident beam direction. It is readily shown that the higher the refractive index of the material is, the smaller the focus region becomes while it nears the sphere and eventually enters the sphere (for refractive indices larger than 2). Likewise, it can be shown that the cone angle of the returning beam becomes smallest for materials with a refractive index of about 1.547, while smaller and larger refractive indices show larger exit cones. Nowadays, tiny beads with a size between 10 and 500 microns are readily available.

Such glass beads are used in coatings on predominantly planar structures such as strips, or traffic signs or the like. With planar structures of a given area a lot of light is readily caught and returned, while elongated, cylindrical structures having the same retroreflective area do not have a large head-on reflection as already half of the area is concealed behind the carrier. However, elongated cylindrical structures have the advantage that they keep on reflecting for each radial incident beam of light while for a planar structure the reflection readily diminishes when the beam strikes the surface off normal.

Most of the methods known today to make an elongated retroreflecting product rely on the use of strips that on themselves are retroreflective. Known techniques to apply those strips on elongated products are taping and wrapping. An example of this is given in U.S. Pat. No. 6,355,349 wherein a steel wire rope is wrapped into a reflective strip and subsequently coated with a clear coating. Another way to make retroreflective elongated products is to start from a retroreflective foil that is slit into narrow strips. These 'threads' are twined together into a yarn or rope as described in U.S. Pat. No. 4,697,407. US 2004/0180199 is a publication that describes a method to embed the retroreflective beads or pyramids into a polymer that is subsequently melt spun to form a yarn. So here the beads are inside the thread and not only at the surface.

Working with strips that are wrapped or taped around elongated products entails some drawbacks. As these products are normally used outdoors, there is a risk that the strip loosens from the product even if an adhesive has been used, due to the weather conditions. There is also a cost disadvantage in that first a retroreflective tape has to be made that is then subsequently wrapped around the product. There is also a tendency for the wrapped strip to tear when the elongated product is bent.

SUMMARY OF THE INVENTION

It is therefore an object to do away with the disadvantages of the prior-art. Moreover it is an object of the present invention to provide an elongated metal wire product that is more robust in its use than the known products. Additionally, the inventive product can be produced in a more economical way. Such an elongated wire product is intended to be used as a spoke in a bicycle wheel or can be used to delimit motorways or they can be used for advertising or in any other similar way.

According a first aspect of the invention, an elongated wire product is provided. Such an elongated wire product is made up—amongst others things—out of one or more metal wires. An elongated wire product containing a single wire is of course the most basic starting point for the invention. This wire is not necessarily round: the wire can be flattened or can have a rectangular or square cross section, or any other shape. However, some metal wires can also be assembled together according the techniques known in the art. One such known technique is to twist the wires together so that they form a strand. The strands on their turn can be assembled so as to form a metal wire rope. Another known technique is to bundle the filaments together into a bunch of wires. This bunch can be held together by gluing the filaments together or by wrapping the bunch with a wrapping wire. The metal wire product further comprises a polymer coating that covers said metal wires. This first coating covers the metal wire assembly at least circumferentially. This coating may or may not be transparent to visible light. However, it is more preferred if this first coating is not transparent i.e. is opaque. The first polymer layer can be coloured by adding fillers to the polymer. Diffusive scattering filler particles—such as aluminium or nickel flakes—could also be added in order to enhance the overall reflectivity. But by far the best is that the polymer is white, as this has been found to increase the visibility even further. On top of this first coating a second, clear and transparent coating has been applied.

Peculiar about this metal wire product is now that in between the first and second coating retroreflective beads are incorporated. The beads are actually held in place in between this first and second coating. Each of the beads is partly embedded in the first coating. Preferably at least a quarter of the bead surface is embedded into the first polymer layer. It is most preferred if about half of the bead surface is embedded into the first coating. When more than half of the bead surface is covered by the first coating, the retroreflective properties of the bead are negatively affected, so such a situation should be avoided. It will hence be clear to the person skilled in the art that the first coating must have a minimum thickness of at least a quarter of the diameter of the bead, while more preferred is that the first coating has a minimum thickness of at least half of the diameter of the bead. With minimum thickness is meant the minimum of all coating widths as measured in the radial direction on a cross section of the metal wire product.

The remaining part of the bead is covered by the second coating thereby protecting the bead from outside influences. This coating does not have to have a uniform thickness but at least it must partly cover the beads protruding from the first coating. Better is if the protruding part is fully covered. It is conjectured that when the second coating conformally encloses the bead, the most uniform retroreflective action is obtained. The thickness of the second coating should be sufficient to hold the bead in place even if they are only partly covered with the second layer. When the bead is fully covered with the second coating, the beads will be better protected from weather influences or handling damage. On the other hand the second coating should not be too thick as this could lead to additional light attenuation. Suitable thickness ranges have been found to be from 3 to 300 micron, preferably from 10 to 100 micron. It is preferred that the first and second coating adhere to one another to some degree. This can be accomplished by using compatible polymers or even better polymers of the same type in the first and second coating.

The metal wires forming the elongated metal wire product can be made of any commercially interesting metal or metal alloy such as stainless steel or plain carbon steel although copper or copper alloy wire or aluminium or aluminium alloy wires or any comparable metal are equally well useable. The metal should be chosen in function of the further use of the metal wire product. If for example electrical conduction is desired for the metal wire product, the choice for a copper alloy is clearly an appropriate one.

Particularly preferred metal wires are stainless steel wires in case the metal wire product is to be used in corrosive circumstances where strength is also an issue. In this respect stainless steel wires are particularly used for spokes of wheels. Stainless steels contain a minimum of 12 wt % Cr and a substantial amount of nickel. More preferred are austenitic stainless steels, which lend themselves more to cold forming. The most preferred compositions are known in the art as AISI (American Iron and Steel Institute) 302, AISI 301, AISI 304 and AISI 316.

Most preferred metal wires are plain carbon steel wires. Usually the distinction is made there between low carbon steel and high carbon steel. Low carbon steels generally contain less than 0.4 wt. % of carbon the remainder being substantially iron and inevitable impurities. Such steel wires are easily bendable and formable and can therefore be used to form specific shapes out of it such as e.g. a coat hanger or an alphanumeric sign or pictogram. High carbon steel generally comprises a minimum carbon content of 0.40 wt % C or at least 0.70 wt % C but most preferably at least 0.80 wt % C with a maximum of 1.1 wt % C, a manganese content ranging from 0.10 to 0.90 wt % Mn, the sulfur and phosphorous contents are each preferably kept below 0.03 wt %; additional micro-alloying elements such as chromium (up to 0.2 to 0.4 wt %), boron, cobalt, nickel, vanadium—a non-exhaustive enumeration—may also be added. High carbon steels are particularly well suited where strength is an issue like for example in retroreflecting highway crash barriers.

In order to improve the corrosion resistance of the plain carbon steel wire, a metal or metal alloy coating can be applied onto it. The metal or metal alloy coating comprises for example a zinc coating or a zinc alloy coating, such as a zinc-aluminium or a zinc-nickel coating preferentially applied through a hot-dip coating process. A preferred zinc-aluminium coating comprises between 2 and 15% Al. Possibly, between 0.1 and 0.4% of a rare earth element such as Ce and/or La can be added in order to improve properties like fluidity and wettability of the melt.

Adequate polymers for the first coating are polymers out of the group of polyethyleneterephtalate, polyvinylchloride, polypropylene, polybutene, polybuthyleneterephtalate, thermoplastic polyurethane, polyamide 6, polyamide 6.6. Blends of polymers comprising one or more of the above mentioned polymers can also be used. These polymers can be present in various forms such as homopolymers, copolymers and block-copolymers. In addition pigments can be added to the compound mixture in order to give the coating the desired colour.

Suitable polymers for the second coating are polymers out of the group of polyacryl, polyethyleneterephtalate, polybuthyleneterephtalate, polyvinylchloride, fluoropolymers such as polyvinylidene fluoride or ethylene tetrafluorethylene, metallocene plastomers and thermoplastic polyurethane in their transparant version. Again blends of the above polymers are not excluded as well as block- or copolymers of compatible polymers. In order to prevent UV degradation of the coating it is advisable to introduce a UV shielding agent. There is no substantial decrease of reflectivity if the second layer is slightly coloured to give it in ambient light a coloured aspect.

The retroreflective beads have a diameter of between 20 and 150 micron, but the most preferred sizes are between 75 to 105 micron and between 20 and 40 micron, wherein the former size is somewhat more preferred as it tends to be less expensive. This puts the minimum coating thickness of the first coating around 10 micron, but more preferred is to have a minimum thickness in between 30 and 50 micron. The refractive index of the retroreflective beads is between 1.5 and 2.2 the higher number being the most preferred. Illustrative but non-delimiting material compositions for the retroreflecting beads are that they include from 10 to 15 wt. % $TiO_2$ (titaniumdioxide) and BaO (bariumoxide) next to $SiO_2$ (silicondioxide). By preference the beads are coated with a reflective coating. Only that part of the surface of the bead that is in contact with the first coating must be coated with a reflective coating. By preference this contact area is at least one quarter of the total bead area. Likewise it is preferred that this contact area is less than half of the total bead area.

Up to now it has always been understood that the assembly of metal wires has been coated with the specified coatings in its entirety. I.e. the starting point was a metallic wire or a strand or a cable. It is equally well in line with the invention to provide a number of separate metal wires of which at least one is coated with retroreflective coating and subsequently assemble those wires into an elongated metal wire product like a strand or cord. Although this method is less preferred in that it is more expensive, the undulated shape of the at least one retroreflective metal wire remains clearly visible in the dark, giving it an added visual appeal.

BRIEF DESCRIPTION OF THE DRAWINGS

The invention will now be described into more detail with reference to the examples depicted in the accompanying drawings wherein.

DESCRIPTION OF THE PREFERRED EMBODIMENTS OF THE INVENTION

Figure 1:
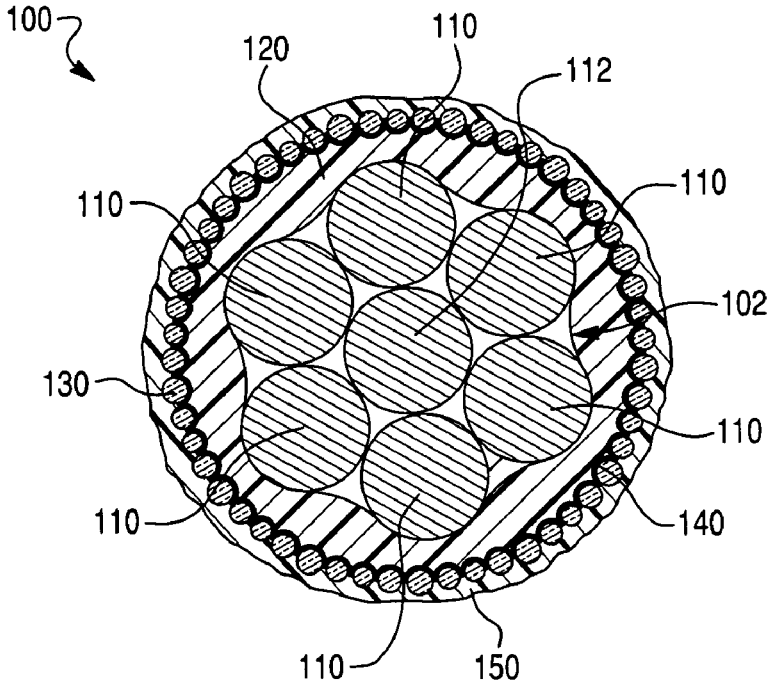
FIG. 1 shows a schematic cross section of an elongated metal wire product according the invention comprising a 1+6 strand.

A first preferred embodiment is shown if FIG. 1. There a steel strand 102 comprising six steel wires 110 that are twisted around a core wire 112 with a pitch of 22 mm in the 'S' lay direction is shown. The core wire has a diameter of 0.45 mm and the outer wire a diameter 0.40 mm. A first layer 120 of polyethylene terephtalate (PET) is extruded around the steel strand. The PET coating thickness varies between 110 and 20 μm. In this first coating layer beads 130 are partly embedded (note that the items in the embodiment are not drawn to scale in the figure). The beads have an average diameter of 90 μm with a range between 75 and 105 μm. The beads are partly embedded in the coating with a depth of between 25 and 50% of their diameter, although some of them are buried deeper into the coating. The back of the beads 140 is silver coated. On top of the beads a clear polyacryl coating 150 has been applied by spraying a polyacryl aerosol onto the elongated wire product. The coating follows substantially conformal the shape of the beads.

Figure 2:
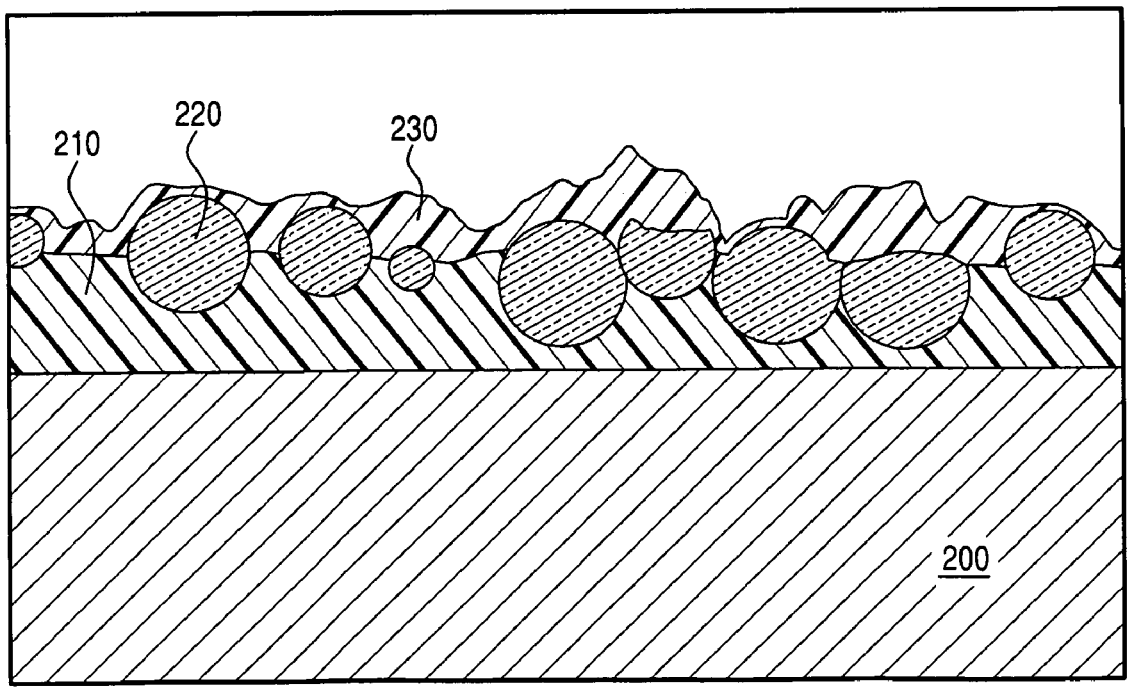
FIG. 2 shows a picture of a cross section of a single wire according the invention.

A second preferred embodiment is depicted in FIG. 2. There a single, low carbon steel wire 200 with a diameter of 2 mm has been extrusion coated first with a polyester coating loaded with a black pigment 210. Silver coated beads 220 with a diameter between 75 and 105 μm with a refractive index of 2.2 where applied onto the still soft polyester coating. The wire was subsequently cooled. The silver coating on the exposed surface of the beads was etched away in a nitric acid solution. Thereafter they were coated with polyacryl 230 coating.

In a third preferred embodiment a 2 mm zinc covered low carbon wire was extrusion coated with a clear PET as a first coating layer. Silver coated 75 to 105 μm where stuck into the still hot coating in a fluidised bed. The uncoated silver was dissolved in hydrogen peroxide acetic acid mixture. Subsequently a polyethylene passiviation layer was dip coated onto the wire (SurTec® 2502). Small pieces of wire were arranged parallel to one another and compared to a flat frame covered with Scotchlite® retroreflective tape, obtainable from 3M. By varying parameters such as speed, and second coating thickness, the best results obtained were 15% compared to the flat reference. The sample was also tested for corrosion in a standard salt spray and humidity cabinet. After 1000 hrs of testing, no noticeable corrosion was visible.

Figure 3:
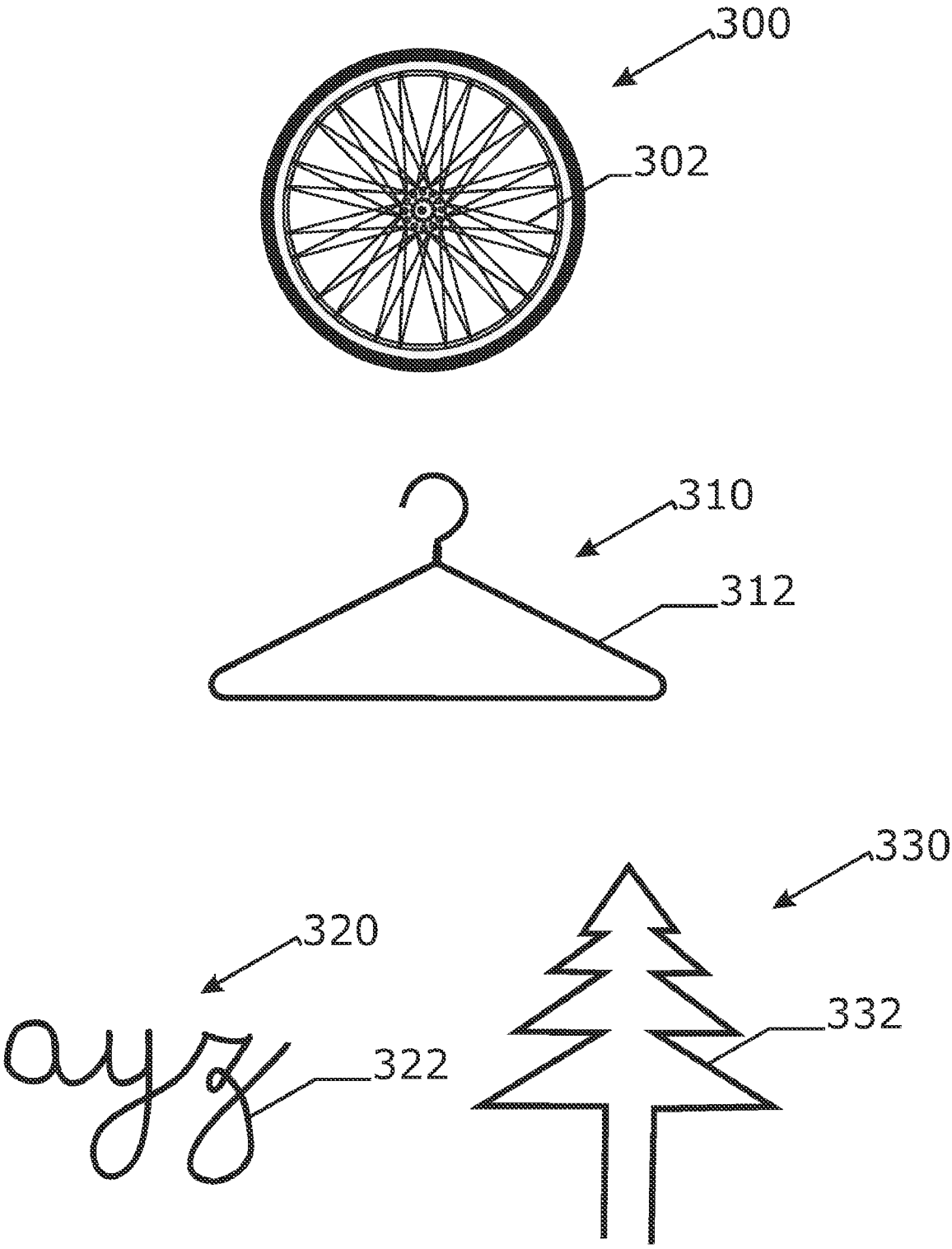
FIG. 3 shows some of the possible uses of such a retroreflecting elongated wire product.

In FIG. 3, different uses of the elongated metal wire product are demonstrated. Without being exhaustive, the elongated metal wire product can be used for:

Spokes 302 made from retroreflective stainless steel wire for wheels 300

Cloth hangers 310 made of retroreflective low-carbon wire 312

Bookbinding wire

Wire and strands for use in jewellery

Wires and strands for use in fences

Champagne cork wire

Advertising means 320, 330 made from easily bendable, retro-reflective low carbon strands 322, 332

Traffic signalisation.

The invention claimed is:

1. An elongated metal wire product comprising:

one or more metal wires, a first polymer coating covering said one or more metal wires, a second transparent polymer coating deposited on top of said first coating, and retro reflective beads with a diameter of between 20 and 150 microns, wherein each of said beads is partly embedded in said first coating, wherein a remainder of each bead is at least partly covered by said second coating.

2. The elongated metal wire product of claim 1, wherein said beads are completely covered by said second coating.

3. The elongated metal wire product of claim 1, wherein said metal is steel.

4. The elongated metal wire product according to claim 1, wherein said first coating is opaque.

5. The elongated metal wire product according to claim 1, wherein said first coating is clear.

6. The elongated metal wire product according to claim 1, wherein said first polymer coating comprises one polymer out of the group consisting of polyethyleneterephtalate, polyvinylchloride, polybuthyleneterephtalate, polypropylene, polybutene, thermoplastic polyurethane, polyamide 6, polyamide 6-6 and blends thereof.

7. The elongated metal wire product according to claim 1, wherein said second transparent polymer coating comprises one polymer out of the group consisting of polyethylene, polyacryl, polyethyleneterephtalate, polyvinylchloride, fluoropolymers, polybuthyleneterephtalate, metallocene plastomers and thermoplastic polyurethane and blends thereof.

8. The elongated metal wire product according to claim 1, wherein said retro reflective beads have a reflective coating on a surface of the beads that is in contact with said first coating.

9. The elongated metal wire product according to claim 8, wherein a surface area of said reflective coating that is in contact with said first coating is more than one quarter of a surface area of the beads.

10. The elongated metal wire product according to claim 9, wherein the surface area of said reflective coating that is in contact with said first coating is less than half of the surface area of the beads.

11. The elongated metal wire product according to claim 1, wherein said metal wire product includes just one metal wire.

12. An elongated metal wire product comprising at least two elongated metal wire products of which at least one is elongated metal wire product according to claim 1.

13. The elongated metal wire product according to claim 1, wherein the retro reflective beads have a spherical shape.

14. The elongated metal wire product according to claim 1, wherein the first polymer coating is in direct contact with said metal wires.

* * * * *